United States Patent [19]

Gadefelt et al.

[11] Patent Number: 4,672,926

[45] Date of Patent: Jun. 16, 1987

[54] ARRANGEMENT FOR HYDRAULIC PRESSURE FEED IN INTERNAL COMBUSTION ENGINES

[75] Inventors: Bengt G. Gadefelt, Södertälje; Lars E. Bergsten, Järna, both of Sweden

[73] Assignee: Saab-Scania Aktiebolag, Sodertalje, Sweden

[21] Appl. No.: 571,797

[22] Filed: Jan. 18, 1984

[30] Foreign Application Priority Data

Jan. 20, 1983 [SE] Sweden ..... 8300282

[51] Int. Cl.[4] ..... F01L 1/24

[52] U.S. Cl. ..... 123/90.34; 123/90.27

[58] Field of Search ..... 123/90.27, 90.33, 90.34, 123/90.35

[56] References Cited

U.S. PATENT DOCUMENTS

| | | | |
|---|---|---|---|
| 2,641,235 | 6/1953 | Slonneger | 123/90.36 |
| 3,412,720 | 11/1968 | Binder | 123/90.27 |
| 3,877,446 | 4/1975 | Morgan | 123/90.55 |
| 4,258,673 | 3/1981 | Stoody, Jr. et al. | 123/90.34 |
| 4,430,968 | 2/1984 | Futakuchi et al. | 123/90.27 |
| 4,441,465 | 4/1984 | Nakamura | 123/90.34 |

FOREIGN PATENT DOCUMENTS

| | | | |
|---|---|---|---|
| 842288 | 3/1952 | Fed. Rep. of Germany | 123/90.33 |
| 603053 | 6/1948 | United Kingdom | 123/90.34 |
| 1118910 | 7/1966 | United Kingdom | 123/90.27 |
| 1040793 | 9/1966 | United Kingdom | 123/90.27 |

OTHER PUBLICATIONS

European Patent Application 0030781, 6/24/81, Buente.

*Primary Examiner*—William R. Cline
*Assistant Examiner*—Peggy A. Neils
*Attorney, Agent, or Firm*—Cushman, Darby & Cushman

[57] ABSTRACT

An arrangement for hydraulic pressure feed to self-adjusting hydraulic valve pushers in an internal combustion engine has a number of valves arranged in line in the engine cylinder head. The valve pushers are actuable by a cam shaft rotatably mounted in a number of bearings mounted on the cylinder head above the valves and the valve pushers. For providing the valve pushers and cam shaft bearings with satisfactory hydraulic pressure feed via a passage system limited in the cylinder head, in a simple and inexpensive way, the pressure oil is fed via a distribution conduit running along the line of valves and having a number of branch conduits. Each branch conduit extends in a plane at right angles to the cam shaft through one of its bearings, for pressure feed to said bearing and to at least one valve pusher. Each branch conduit preferably connects to a pocket formed in the cylinder head connecting the bearings of two valve pushers to each other.

9 Claims, 3 Drawing Figures

ARRANGEMENT FOR HYDRAULIC PRESSURE FEED IN INTERNAL COMBUSTION ENGINES

Figure 1:
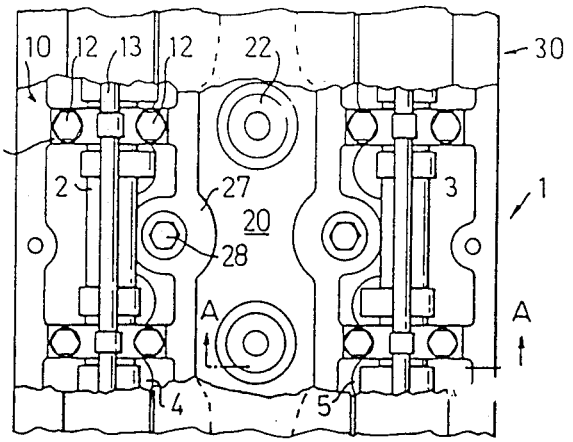

The present invention relates to an arrangement for hydraulic pressure feed to self-adjusting hydraulic valve pushers in an internal combustion engine having a number of valves arranged in line in the engine cylinder head, these valves being actuable via said valve pushers by a cam shaft rotatably mounted in a plurality of bearings on the cylinder head and situated above the valves and the valve pushers.

It is already known in internal combustion engines to supply hydraulic pressure to valve pushers via a distribution passage bored in the cylinder head and extending parallel to the cam shaft of the engine. In the cases where the cylinder head is subdivided into a lower and an upper part, i.e. a cylinder block and a cam shaft bridge with a parting plane on a level with the lower seats of the valve springs, it is also known to form this distribution passage in the parting plane. In certain cases the cylinder head may be formed in one piece containing the mountings of the valve pushers as well, the distribution passage then being bored outside said mounting in a section of material suitable for the purpose. Hydraulic pressure is then taken from the distribution passage via separate cross passages to the valve pushers and also to the cam shaft bearings.

In the known art, the relatively large number of passages means increased complexity in the design and manufacture of the cylinder head. The cylinder head must be formed with suitable material sections for the bores, and must furthermore be suited to carrying out the boring operations. In turn, the boring operations require expensive machines and are also time-consuming to carry out, particularly with respect to long passages with meeting passages in several different directions. With an increasing number of passages there is also an increased risk of error which may result in expensive cylinder head rejections.

The present invention has the object of ensuring completely satisfactory hydraulic pressure feed to valve pushers and cam shaft bearings in internal combustion engines via a simple and cheap passage system limiting the number of required passages in the cylinder head. To this end the invention is substantially distinguished in that the hydraulic pressure feed takes place via a distribution conduit that runs along the line of valves and that is provided with a number of branch conduits. Each branch line extends in a plane at right angles to the cam shaft through one of its bearings, for pressure feed to said bearing and to at least one valve pusher.

In the inventive solution, one bearing and two valve pushers obtain hydraulic oil feed from one and the same branch line. As a result of this, the branch lines can be concentrated to portions adjacent the bearings of the cam shaft. In an advantageous embodiment of the invention, each branch line opens out into a pocket formed in the cylinder head and connecting the mountings of two valve pushers to each other. Such an implementation is advantageous from the manufacturing aspect since it eliminates time-consuming boring operations in several planes.

Figure 3:
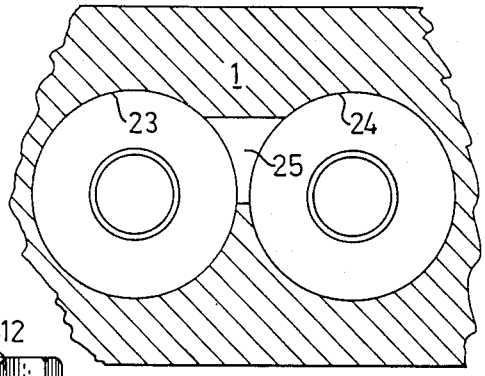

Remaining features distinguishing the invention will be seen from the apended claims and the following description of an embodiment exemplifying the invention. The description is carried out with reference to the accompanying figures, of which FIG. 1 is a partial plan view of the cylinder head of an Otto engine with the valve cover partially cut away, FIG. 2 is a section A—A in FIG. 1, the figure also partially depicting in section the cap of the adjacent bearing, and FIG. 3 is a section B—B in FIG. 2, with the valve pusher removed.

Figure 2:
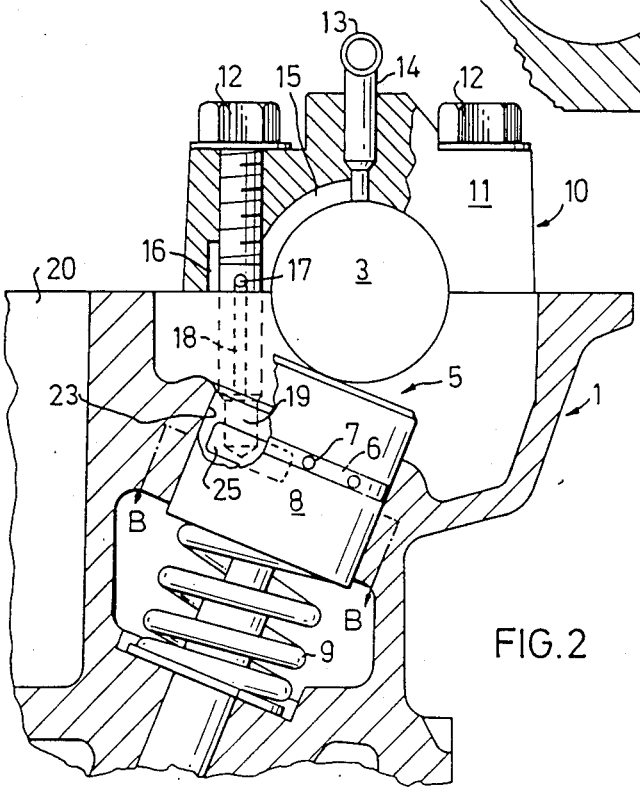

FIG. 1 illustrates a portion of a cylinder head 1 for an in-line engine with dual overhead cam shafts 2,3. The cylinder head 1 is cast in one piece and each cam shaft 2,3 is journalled in a plurality of bearings 10. At each bearing 10 a bearing cap 11 is attached to the cylinder head 1 by two screws 12.

Each cam shaft 2,3 is conventionally formed with cams, not shown, adapted for actuating via valve pushers 8 the valves 4,5 against the bias of valve springs 9. One cam shaft 2 is adapted to control the engine exhaust valves 4 and the other cam shaft 3 is adapted to control the engine inlet valves 5.

The principal implementation of the cylinder head 1 about the two cam shafts is the same, and one half may therefore be regarded as being to opposite hand of the other half. Only one half of the cylinder head 1 illustrated in the figure is therefore referred to in the description. Since the implementation of the cam shaft bearings is principally the same, only one of four bearings 10 is provided with reference numerals.

Parallel to each cam shaft 2,3 runs an oil distribution pipe 13 which is connected to the bearing caps 11 via a number of connection nipples 14. Each oil distribution pipe 13 is intended to lead lubricating oil to the bearings 10, which are placed such as to be between two exhaust valves 4 forming a pair of exhaust valves, or between two inlet valves 5, forming a pair of inlet valves. The valves in each pair are assigned to one and the same combustion chamber (not shown) in the engine.

In the cylinder head 1 there is provided between the cam shafts 2,3 a trough 20 from the bottom of which wells 22, for receiving spark plugs (not shown), extend towards the combustion chambers of the engine. As will be seen from FIG. 1, the trough 20 is formed with constrictions 27 constituting reinforcements formed in the cylinder head 1. These reinforcements are implemented with through-holes for screws 28, with which the cylinder head 1 is attached to a cylinder block (not shown). The upper part of the trough 20 is limited by a valve cover 30 fastened to the cylinder head 1 with a number of screws (not shown).

As will be seen from FIG. 2, oil is intended to be lead from the oil distribution pipe 13 via a connection nipple 14 to a first pocket 15 formed in the bearing cap 11. The pocket 15 is in turn in communication with a free space 16 surrounding the screw 12. The screw 12 is provided with at least one transverse bore 17 in the region of said free space 16, the bore 17 being in communication with a centrally drilled longitudinal passage 18 in the lower part of the screw 12. The screw 12 opens out into a second; and pocket 25 common to two adjacent valve pusher bearings 23,24. As will be seen from Fig. 3, the pocket 25 constitutes a through-passage between the valve pusher bearings. The second pocket 25 can easily be formed in casting the cylinder head 1. However, it should be understood here that there is the alternative possibility of completely avoiding this pocket by extending the bore 19 such that it opens out in the bearing surfaces of the valve pusher bearings 23,24, thereby providing for hydraulic pressure supply to these surfaces.

The valve pushers 8, which are of a hydraulically operating self-adjusting type, are known per se, and are therefore not described further. Examples of such valve pushers may be found in the European Pat. Nos. 30780 and 30781.

In the cylindrical mantle surface of each valve pusher 8 there is a peripheral groove 6 having communication via a radial hole 7 or a radial opening with the interior space of the valve pusher. This means that when the groove 6 is in communication with the passage 25, oil can be urged into the valve pusher 8 via the groove 6 and the openings 7. By providing a relative longitudinal movement between the outer portion of the valve pusher 8 and an inner portion (not shown) engaging against the valve stem, the occurrence of play between these parts is eliminated by the pressurized oil.

Pressurized oil lubrication is thus provided for via the oil distribution pipe 13, not only of the respective cam shaft 2,3 via the connection nipple 14 and pocket 15, but also of the valve pushers 8 by leading the oil via the free space 16, the transverse bore 17, the longitudinal central passage 18 in the screw 12, the bore 19 and the second pocket 25.

In an alternative embodiment of the invention, the oil distribution pipe 13 has been moved from its central placing in FIGS. 1 and 2 on the bearing cap 11 and is connected instead to a connection piece for the bored screw 12. The longitudinal passage or bore 18 in the lower part of the screw is thus in communication with the connection piece via a transverse passage in a similar way as the example illustrated in FIG. 2. Pressurized oil is taken to the valve pusher 8 via the longitudinal bore 18 in the screw 12, the bore 19 and the second pocket 25. in this case, the cam shaft bearing 10 is provided with lubrication by oil from the connection piece being fed to the first pocket 15 formed in the bearing cap 11 via the annular gap occurring between the screw 12 and the free hole made in the bearing cap 11.

The hydraulic pressure feed may be modified into other embodiments within the scope of the inventive concept and the following claims. The possibility should thus not be excluded that the pressurized oil supply to both cam shaft bearing 10 and two adjacent valve pushers 8 may take place via the outer of the screws 12, a transverse bore connecting the bore of this screw with a pocket common to two adjacent valve pushers 8. In this case the oil distribution pipe 13 can either be situated above the bearing cap 11 or on the outside of the cylinder head 1, in level with said transverse bore. The pipe 13 can of course be replaced in the latter case by a longitudinal passage bored at the same level in the material of the cylinder head 1.

What we claim is:

1. An arrangement for hydraulic pressure feed to self-adjusting hydraulic valve pushers in an overhead cam internal combustion engine having a plurality of valves within a cylinder head, each valve being actuated by a valve pusher reciprocatingly supported in a bearing in the cylinder head above the valve, a rotatably mounted cam shaft supported by a plurality of bearings and disposed above the valve pushers for directly actuating the valve pushers, the hydraulic pressure feed comprising a distribution conduit extending along the cylinder head, a plurality of branch conduits communicating the distribution conduit, with at least one bearing of the cam shaft, said bearing being in communication with two valve pushers through a conduit including a passage in a screw, said passage opening out into a pocket contiguous to each of said two valve pushers whereby hydraulic oil is suplied from the distribution conduit to the valve pushers.

2. An arrangement for hydraulic pressure feed to self-adjusting hydraulic valve pushers in an overhead cam engine having a plurality of valves within a cylinder head, each valve being atuated by a valve pusher reciprocatingly suported in the cylinder head above the valve, a rotatably mounted cam shaft supported by a plurality of bearings in the cylinder head for actuating the valve pushers, the hydraulic pressure feed comprising a distribution conduit extending the length of the cylinder head, a plurality of branch conduits leading from the distribution conduit to the cam shaft bearings, a conduit leading from a cam shaft bearing to a second pocket contiguous to the bearings of two valve pushers, the cam shaft bearing being provided with a first pocket to receive fluid from the distribution conduit, the first pocket being in communication with the distribution conduit and the conduit leading to the two valve pushers, said conduit comprising a passage in a screw and a bore for mounting the screw, said screw fastening a bearing cap of said cam shaft bearing whereby hydraulic fluid is supplied to the valve pusher.

3. An arrangement for hydraulic pressure feed to self-adjusting hydraulic valve pushers in an internal combustion engine having a cylinder head and a plurality of valves arranged in line in the cylinder head, these valves being actuable via said valve pushers by a cam shaft rotably mounted in a plurality of bearings on the cylinder head and situated above the valves and the valve pushers, each valve pusher being reciprocatingly supported in a bearing in the cylinder head, the hydraulic pressure feed taking place via a distribution conduit that runs along the line of valves and that is provided with a number of branch conduits, each branch conduit extending in a plane at right angles to the cam shaft through one of its bearings characterized in that each branch conduit connects the bearings of only two valve pushers to each other, and in that each branch conduit includes a passage formed longitudinally in a screw, said screw fatening a bearing cap of one of the bearings for the cam shaft, and a bore for mounting the screw, whereby each branch conduit fees hydraulic pressure to a pocket contiguous to said two valve pushers as well as to said cam shaft bearing.

4. An arrangement as in claim 3, characterized in that the bore opens out in a pocket formed in the cylinder head, said pocket connecting the bearings for the two valve pushers to each other.

5. An arrangement as in claim 3, characterized in that the branch conduit only partially passes through the screw fastening the bearing cap to the cylinder block, and in that the screw is formed with a radial inlet hole extending to its longitudinal passage.

6. An arrangement as in claim 5, characterized in that the bearing cap is formed with an interior pocket for carrying oil from a connection nipple via the radial inlet hole into the screw.

7. An arrangement in claim 3, characterized in that the distribution conduit is formed by a pipe which is situated above the cam shaft and attached to the cylinder head and in that each branch conduit feeds hydraulic pressure to said two valve pushers via the bearing cap included in the bearing for the cam shaft.

8. An arrangement for hydraulic pressure feed to self-adjusting hydraulic valve pushers in an overhead cam engine having a plurality of valves within a cylinder head, each valve being actuated by a valve pusher extending in a first axial direction and reciprocatingly supported in the cylinder head above the valve, a rotatably mounted cam shaft supported by a plurality of bearings in the cylinder head for actuating the valve pushers, the hydraulic pressure feed comprising a distribution conduit extending the length of the cylinder head, a plurality of branch conduits leading from the distribution conduit to the cam shaft bearings, a conduit leading from a cam shaft bearing two two valve pushers, the cam shaft bearing being provided with a pocket to receive fluid from the distribution conduit, the pocket being in communication with the distribution conduit and the conduit leading to the two valve pushers, and a conduit comprising a passage in a screw and a bore for mounting the screw, said screw fastening a bearing cap of said cam shaft bearing, said bore having a second axial direction which forms an acute angle with the first axial direction of said valve pushers, and opening out in the bearings of said two valve pushers, whereby hydraulic fluid is supplied to the valve pusher.

9. An arrangement for hydraulic feed to self-adjusting hydraulic pushers in an internal combustion engine having a cylinder head and a plurality of valves arranged in a line in the cylinder head, these valves being actuable via said valve pushers by a cam shaft rotatably mounted in a plurality of bearings on the cylinder head and situated above the valve and the valve pushers, each valve pusher being reciprocatingly supported in a bearing in the cylinder head, the hydraulic pressure feed taking place via a distribution conduit that runs along the line of valves and that is provided with a number of branch conduits, each branch conduit extending in a plane at right angles to the cam shaft through one of its bearings characterized in that each branch conduit connects the bearings of only two valve pushers to each other, and in that each branch conduit includes a passage formed longitudinally in a screw, said screw fastening a bearing cap of one of the bearings for the cam shaft, and a bore for mounting the screw, said bore opening out in a pocket formed in the cylinder head, said pocket connecting the bearings for the two valve pushers to each other, whereby each branch conduit feeds hydraulic pressure to said two valve pushers as well as to said cam shaft bearing.

* * * * *